US007229313B1

(12) United States Patent
Keckler

(10) Patent No.: US 7,229,313 B1
(45) Date of Patent: Jun. 12, 2007

(54) ELECTRICAL CONNECTOR DEVICE

(76) Inventor: David A. Keckler, 6801 Shetland Way, Sarasota, FL (US) 34241

( * ) Notice: Subject to any disclaimer, the term of this patent is extended or adjusted under 35 U.S.C. 154(b) by 0 days.

(21) Appl. No.: 11/375,449

(22) Filed: Mar. 14, 2006

(51) Int. Cl.
*H01R 13/40* (2006.01)

(52) U.S. Cl. ..... 439/587; 439/441; 439/272

(58) Field of Classification Search ..... 439/272–276, 439/436–441, 587
See application file for complete search history.

(56) References Cited

U.S. PATENT DOCUMENTS 4,106,835 A 8/1978 Kimm
4,133,596 A 1/1979 Dauser, Jr.
4,210,772 A 7/1980 Magana et al.
4,416,499 A 11/1983 Frascatore et al.
4,627,675 A 12/1986 Taylor et al.
5,199,906 A 4/1993 Wang
5,243,130 A 9/1993 Kitagawa
5,415,564 A 5/1995 Winter et al.
5,454,730 A * 10/1995 Tozuka ..... 439/438
5,490,785 A * 2/1996 Hein et al. ..... 439/76.1
5,975,940 A * 11/1999 Hartmann et al. ..... 439/441
6,280,233 B1 * 8/2001 Beege et al. ..... 439/441
6,325,670 B2 * 12/2001 Murayama ..... 439/587
6,981,890 B2 * 1/2006 Cutler et al. ..... 439/441

* cited by examiner

*Primary Examiner*—Truc Nguyen
(74) *Attorney, Agent, or Firm*—Dale J. Ream

(57) ABSTRACT

An electrical connector device includes a housing defining holes for insertion of wires from different sources but of the same type, e.g. ground wires. The device includes a plurality of first retaining clips, each one being electrically connected to every other first clip so that the first wires are pigtailed upon insertion into the appropriate wire insertion hole. Second and third wire insertion openings and retaining clips may also be provided in like manner to pigtail respective additional wires of like type. The housing is waterproof. Specifically, a puncture seal is positioned in the housing between a wire insertion opening and the retaining clips. The puncture seal, through which each wire must pass, prevents moisture from entering the housing. Further, a wall of the device defines an opening for insertion of a sealant into the interior area between a wire insertion opening and the retaining clips.

16 Claims, 4 Drawing Sheets

Fig. 4b
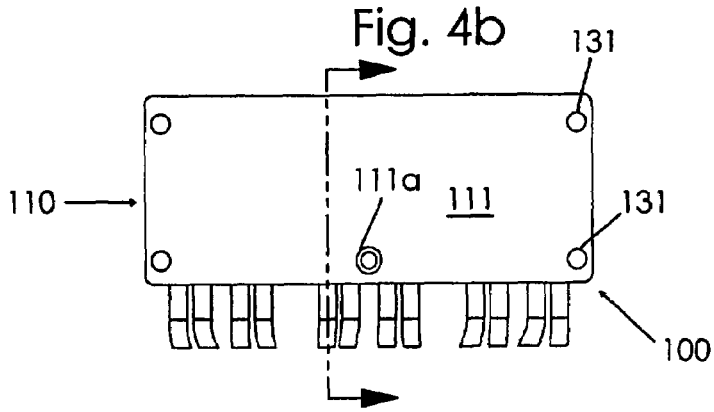
Fig. 4b
Fig. 4a
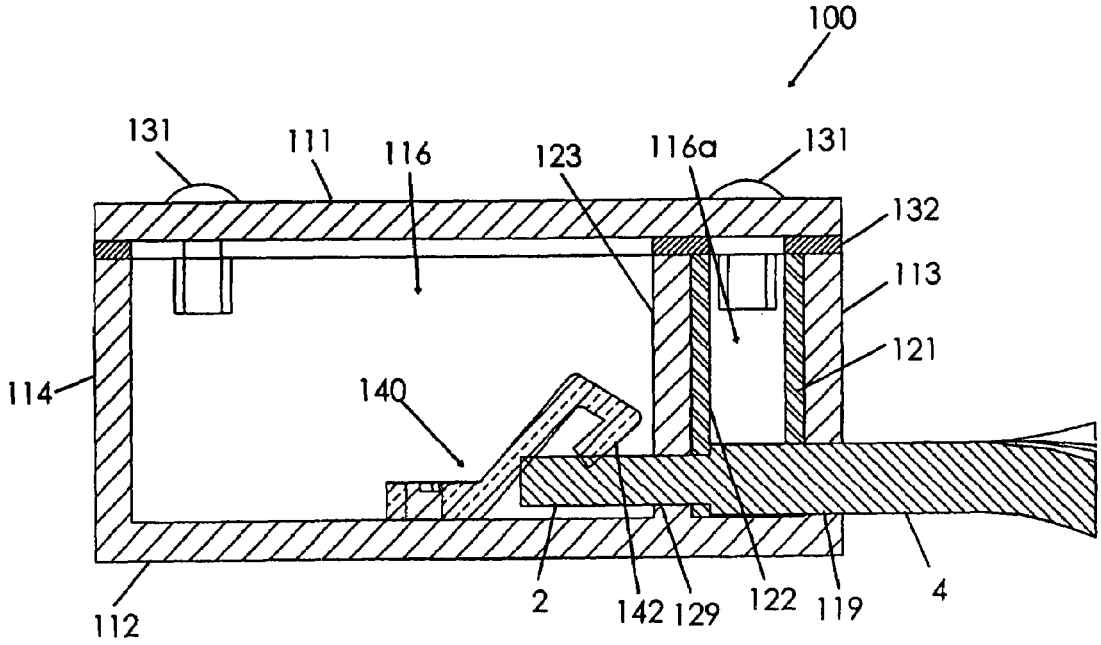
Fig. 4b

ELECTRICAL CONNECTOR DEVICE

BACKGROUND OF THE INVENTION

The present invention relates generally to electrical connectors and, more particularly, to an electrical connector device for easily enabling multiple electrical wires to be "pigtailed" together without the use of wire nuts and in a single housing that is waterproof.

Many electrical jobs require that a main electrical supply be split for connection to multiple locations or multiple electrical devices. The installer has conventionally used wire nuts to make "pigtail" connections between the multiple wire paths and the main source. This frequently results in messy or unreliable connections. Other problems are created when space and moisture are concerns. Regarding moisture, gang boxes having multiple connections must sometimes be completely filled with silicone in order to be waterproof. Regarding space, a gang box full of wires connected by wire nuts can become difficult to manage and confusing as to which wires correspond with which power source.

Although various devices have been proposed in the art for managing the interconnectivity of electrical wires, these products and proposals do not provide a reliably waterproof environment or allow multiple wires to be interconnected in a convenient, efficient, and waterproof manner.

Therefore, it would be desirable to have an electrical connector device for eliminating the mess, inefficiency, and confusion that is experienced with a traditional pigtail arrangement. Further, it would be desirable to have an electrical device that allows multiple wires to be pigtailed without the use of traditional wire nuts. In addition, it would be desirable to have an electrical connector device that is waterproof without inserting silicon or similar material completely into a housing after the electrical connection of wires.

SUMMARY OF THE INVENTION

Accordingly, an electrical connector device according to the present device includes a housing having a front wall defining openings for receiving wires into an interior cavity. The device further includes at least a plurality of first retaining clips with each clip configured to receive and retain an electrical wire. Each first retaining clip is electrically connected to each other first retaining clip such that the wires are electrically pigtailed together. A plurality of second retaining clips and even a plurality of third retaining clips may also be positioned in the housing for receiving and retaining second and third wires, respectively. In like manner, this enables a plurality of second wires to pigtailed to one another and a third set of wires to be pigtailed to one another. None of the second retaining clips are connected to any of the first or third retaining clips and none of the third retaining clips are connected to any of the first retaining clips. As a practical matter, therefore, all ground wires may be electrically connected, all black wires may be electrically connected, and all white wires may be electrically connected for properly pigtailing several independent wire sets.

The electrical connector device further includes several waterproofing elements. At least one puncture seal is positioned between the front wall and the first retaining clips through which wires may be inserted for sealing moisture out of the interior area of the housing. Further, an opening in a top wall enables a user to insert a sealing material into an interior area surrounding inserted wires.

Therefore, a general object of this invention is to provide an electrical connector device that allows multiple wires to be pigtailed without the use of traditional wire nuts.

Another object of this invention is to provided an electrical connector device, as aforesaid, that is waterproof without inserting silicon or similar material into an entire housing after the electrical connection of wires.

Yet another object of this invention is to provide an electrical connector device, as aforesaid, having at least one puncture seal for sealing moisture out of a housing at the point where wires are inserted.

A further object of this invention is to provide an electrical connector device, as aforesaid, having a plurality of wire clips for receiving and retaining like types of wires and for electrically connecting said wires to one another.

Other objects and advantages of the present invention will become apparent from the following description taken in connection with the accompanying drawings, wherein is set forth by way of illustration and example, an embodiment of this invention.

BRIEF DESCRIPTION OF THE DRAWINGS

FIG. 4*a* is a top view of the connector device as in FIG. 3; and

FIG. 4*b* is a sectional view taken along line 4*b*—4*b* as in FIG. 4*a*.

DESCRIPTION OF THE PREFERRED EMBODIMENT

An electrical connector device 100 according to the present invention will now be described in detail with reference to FIGS. 1 through 4*b* of the accompanying drawings. More particularly, an electrical connector device 100 according to the current invention includes a housing 110 and a plurality of first retaining clips 140 disposed in the housing 110.

Figure 1:
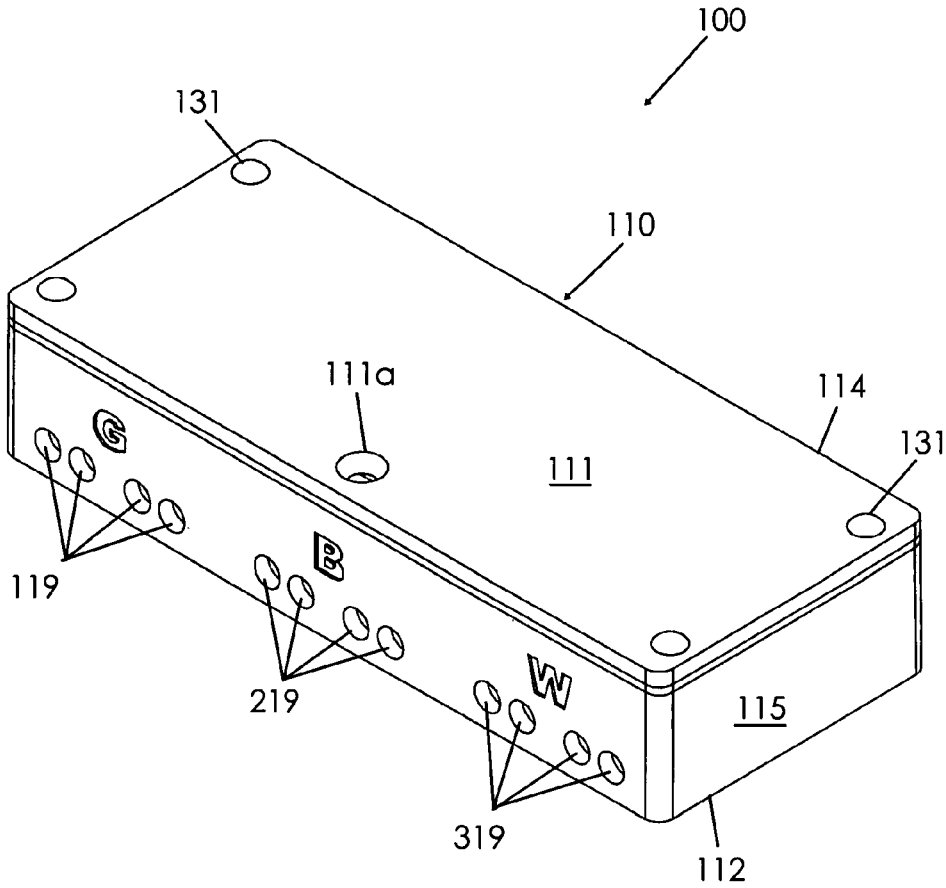
FIG. 1 is a perspective view of an electrical connector device according to a preferred embodiment of the present invention.
Figure 2:
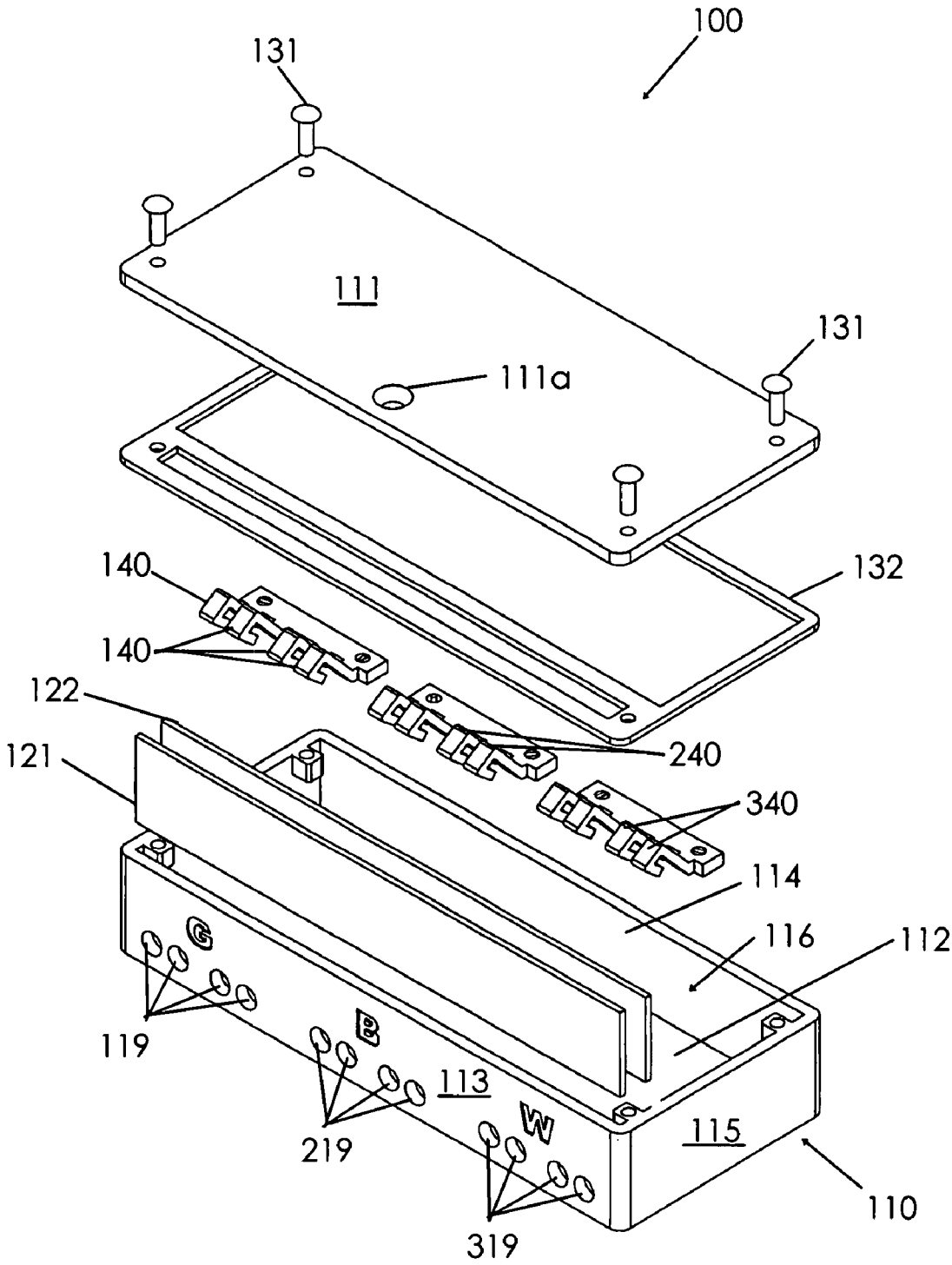
FIG. 2 is an exploded view of the connector device as in FIG. 1.
Figure 3:
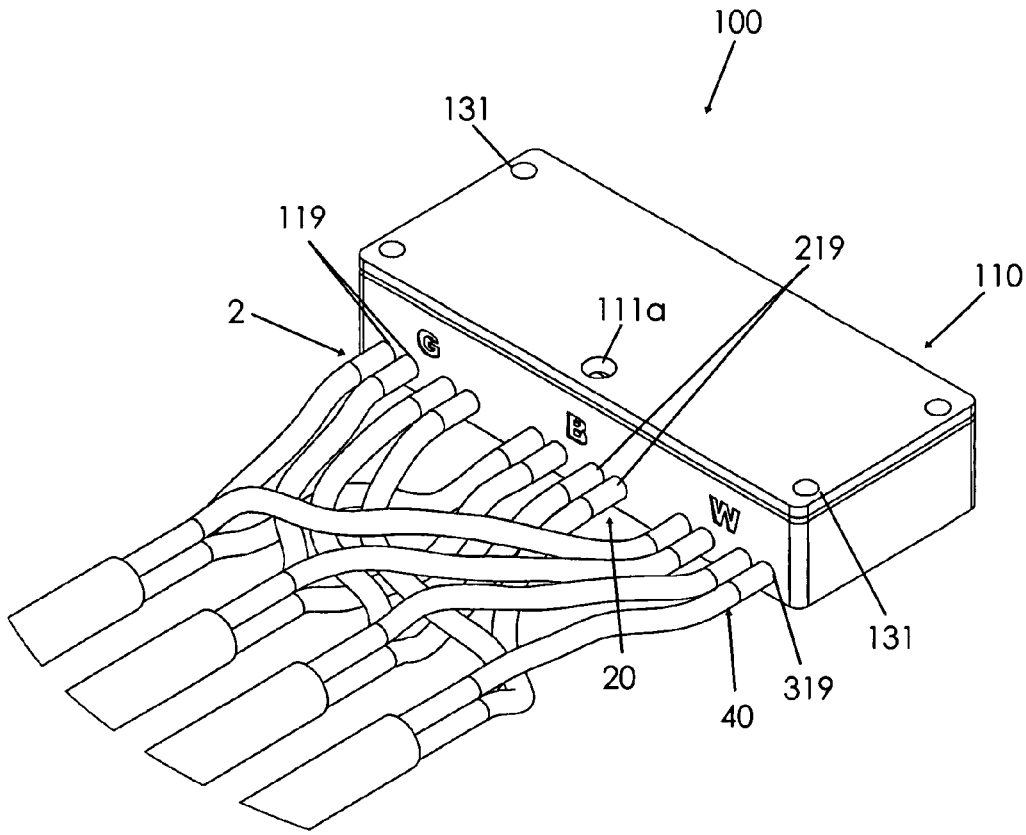
FIG. 3 is another perspective view of the connector device as in FIG. 1 with sets of electrical wires inserted.

The housing 110 includes upper and lower walls 111, 112, front and rear sidewalls 113, 114, and opposed lateral sidewalls 115 that collectively define a cavity 116 (FIG. 2). The housing 110 preferably includes a waterproof construction to keep moisture from reaching first retaining clips 140.

The front sidewalls 113 may define a plurality of openings 119. A respective opening 119 is adjacent each respective first retaining clip 140 for allowing each respective first retaining clip 140 to selectively receive a wire 2. A first puncture seal 121 may be positioned between the front sidewall 113 and the first retaining clips 140 to maintain the waterproof nature of the housing 110. As shown in FIG. 4*b*, the first puncture seal 121 may be adjacent the front sidewall 113.

An inner wall 123 may be positioned between the front sidewall 113 and the first retaining clips 140, as shown in FIG. 4*b*. The inner wall 123 may constructively extend from the upper wall 111 to the lower wall 112, and the inner wall 123 may be displaced from the front sidewall 113 to define a first interior area 116*a*. It should be understood that the inner wall 123 may extend from the upper wall 111 to the lower wall 112 by itself, or that the inner wall 123 and another element may collectively extend from the upper wall 111 to the lower wall 112. The term "constructively" is used herein to include either of these situations. The inner wall 123 defines an opening 129 adjacent each respective first clip 140 for allowing each respective first retaining clip 140 to selectively receive a wire 2. A second puncture seal 122 may be positioned adjacent the inner wall 123, and, as shown in FIG. 4*b*, the second puncture seal 122 may be in the first interior area 116*a*. Each opening 119 in the front sidewall 113 may be sized to receive a respective wire 2 and insulation 4 wrapped around the wire 2, and each opening 129 in the inner wall 123 may be sized to receive only a respective wire 2 without any insulation 4 wrapped around the wire 2 (FIG. 4*b*). By sizing the openings 119, 129 in this manner, moisture is further kept from the first retaining clips 140. Further, the puncture seals may include a material that adheres tightly to a wire that has been inserted therethrough, such as a soft rubber material.

As shown in FIG. 2, fasteners 131 may coupled the upper wall 111 to the lateral sidewalls 115. Alternately, the fasteners 131 may couple the upper wall 111 to the lower wall 112, the front sidewall 113, and/or the rear sidewall 114. A gasket 132 may be positioned between the upper wall 111 and the front sidewall 113, the rear sidewall 114, the lateral sidewalls 115, and/or the inner wall 123 to further waterproof the cavity 116. In addition, the upper wall 111 may define an opening 111*a* to allow a sealant (e.g., silicone) to enter the first interior area 116*a* for further waterproofing the housing 110. In other words, a user may inject a sealant into the interior area 116*a* after the wires have been inserted, whereby to seal the interior from any moisture on the outside of the housing 110.

As shown in FIG. 2, each first retaining clip 140 includes a configuration that is in electrical communication with each other first retaining clip 140. The first retaining clips 140 are positioned in the cavity 116 and may include a respective prong 142 angled to prevent a wire 2 from separating from the first retaining clip 140 (FIG. 4*b*). As will be further explained later, multiple wires of the same type, e.g. ground wires, may be inserted and retained by respective first retaining clips 140 and will be electrically connected thereby.

The front wall 113 and the inner wall 123 may further define openings 219 so that second retaining clips 240 disposed within the housing 110 may receive wires 20. The openings 219 may be adjacent the second retaining clips 240. Similar to the first retaining clips 140, each second retaining clip 240 may be in electrical communication with each other second retaining clip 240. However, no second retaining clip 240 is in electrical communication with any first retaining clip 140. In like manner, the front wall 113 may further define openings 319 for receiving a third set of wires 40. Third retaining clips 340 may also be included for receiving and electrically connecting the third set of wires 40. No third retaining clip 340 is in electrical connection with any first 140 or second 240 retaining clip.

In use, various wires 2 may be inserted through openings 119, through the first puncture seal 121, through the second puncture seal 122, through inner openings 129, and into contact with first retaining clips 140 as shown in FIG. 4*b*. By doing this, electricity passing through one wire 2 is transferred through the first retaining clips 140 and to the other wires 2. The puncture seals 121, 122, the different sizes of openings 119, 129, and the waterproof features of the housing 110 ensure that moisture does not reach the first retaining clips 140. In addition, silicone or another sealant may be inserted through opening 111*a* to make sure moisture cannot reach the first retaining clips 140 through the first interior area 116*a*. The second retaining clips 240 may be used to connect wires 20 of like type, e.g. black wires, in a similar manner. The third retaining clips 340 may be used to connect still further wires 40 of like type, e.g. white wires, in a similar manner.

Accordingly, the black, white, and ground wires from multiple sources may be pigtailed together. Assuming one of these sources is a power source, power may be provided to three additional target devices using this device. It should be understood that the connector device according to the present invention could be adapted to pigtail greater numbers of sources by including more respective wire insertion openings and additional retaining clips in each set.

It is understood that while certain forms of this invention have been illustrated and described, it is not limited thereto except insofar as such limitations are included in the following claims and allowable functional equivalents thereof.

What is claimed is:

1. An electrical connector device, comprising:

a housing having a plurality of first retaining clips disposed therein, each said first retaining clip being in electrical communication with each other first retaining clip;

said housing includes upper and lower walls and at least one sidewall collectively defining a cavity in which said first retaining clips are disposed;

one said sidewall defines an opening adjacent each respective first retaining clip for allowing each respective first retaining clip to selectively receive a wire; and an inner wall between said sidewall defining said openings and said first retaining clips, said inner wall constructively extending from said upper wall to said lower wall and being separated from said sidewall defining said openings to define a first interior area, said inner wall defining an opening adjacent each respective first retaining clip for allowing each respective first retaining clip to selectively receive a wire.

2. The electrical connector device of claim 1, further comprising a first puncture seal between said sidewall defining said openings and said first retaining clips.

3. The electrical connector device of claim 1, further comprising:

a first puncture seal adjacent said sidewall defining said openings, said first puncture seal being between said sidewall defining said openings and said first retaining clips; and a second puncture seal adjacent said inner wall.

4. The electrical connector device of claim 1, wherein:

each said opening in said sidewall is sized to receive a respective wire and insulation wrapped around said wire; and each said opening in said inner wall is sized to receive a respective wire without any insulation wrapped around said wire.

5. The electrical connector device of claim 1, wherein said housing defines an opening to allow a sealant to enter said first interior area.

6. The electrical connector device of claim 1, further comprising a gasket between said housing upper wall and said at least one sidewall of said housing to waterproof said cavity.

7. The electrical connector device of claim 1, further comprising a plurality of second retaining clips disposed within said housing, each said retaining clip being in electrical communication with each other second retaining clip, no said second retaining clip being in electrical communication with any said first retaining clip.

8. The electrical connector device of claim 1, wherein each said first retaining clip includes a respective prong angled to prevent a wire from separating from said first retaining clip.

9. The electrical connector device of claim 7, wherein said sidewall defining said openings adjacent each respective first retaining clip also defines an opening adjacent each respective second retaining clip.

10. An electrical connector device, comprising:

a waterproof housing having upper and lower walls, front and rear sidewalls, and opposed lateral sidewalls, said front sidewall defining a plurality of openings;

a puncture seal adjacent said front sidewall;

a plurality of first retaining clips disposed in said housing, each first retaining clip being adjacent a respective opening in said front sidewall, each first retaining clip being in electrical communication with each other first retaining clip; and an inner wall between said front sidewall and said first retaining clips, said inner wall constructively extending from said upper wall to said lower wall and being separated from said front sidewall to define a first interior area, said inner wall defining an opening adjacent each respective first retaining clip for allowing each respective first retaining clip to receive a wire.

11. The electrical connector device of claim 10, further comprising a second puncture seal adjacent said inner wall in said first interior area.

12. The electrical connector device of claim 10, wherein a fastener couples said upper wall to at least one element selected from the group consisting of said lower wall, said front and rear sidewalls, and said opposed lateral sidewalls.

13. The electrical connector device of claim 10, wherein a fastener couples said upper wall at least one element selected from the group consisting of said lower wall, said front and rear sidewalls, and said opposed lateral sidewalls.

14. The electrical connector device of claim 11, wherein said upper wall defines an opening to allow a sealant to enter said first interior area.

15. The electrical connector device of claim 14, wherein:

each said opening in said front sidewall is sized to receive a respective wire and insulation wrapped around said wire; and each said opening in said inner wall is sized to receive a respective wire without any insulation wrapped around said wire.

16. The electrical connector device of claim 13, further comprising a gasket between said housing upper wall and said housing front and rear sidewalls, said opposed lateral sidewalls, and said inner wall.

* * * * *